US007176749B2

(12) United States Patent
Sharma et al.

(10) Patent No.: US 7,176,749 B2
(45) Date of Patent: Feb. 13, 2007

(54) AVOIDING EXCESSIVE CROSS-TERMINAL VOLTAGES OF LOW VOLTAGE TRANSISTORS DUE TO UNDESIRABLE SUPPLY-SEQUENCING IN ENVIRONMENTS WITH HIGHER SUPPLY VOLTAGES

(75) Inventors: Bhupendra Sharma, Bangalore (IN); Sudheer Prasad, Bangalore (IN); Sandeep K. Oswal, Bangalore (IN)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/711,532

(22) Filed: Sep. 24, 2004

(65) Prior Publication Data

US 2006/0066387 A1 Mar. 30, 2006

(51) Int. Cl.
*G05F 1/10* (2006.01)
*G05F 3/02* (2006.01)

(52) U.S. Cl. ..... 327/538; 327/407

(58) Field of Classification Search ..... 327/407–708
See application file for complete search history.

(56) References Cited

U.S. PATENT DOCUMENTS

| | | | | |
|---|---|---|---|---|
| 5,272,393 | A * | 12/1993 | Horiguchi et al. | 327/535 |
| 5,939,933 | A * | 8/1999 | Wang | 327/512 |
| 5,982,162 | A * | 11/1999 | Yamauchi | 323/316 |
| 6,495,977 | B2 * | 12/2002 | Kumano | 315/370 |
| 6,566,935 | B1 * | 5/2003 | Renous | 327/408 |
| 6,747,510 | B2 * | 6/2004 | Jantzi et al. | 330/51 |
| 2004/0222840 | A1 * | 11/2004 | Yates et al. | 327/530 |

* cited by examiner

*Primary Examiner*—Quan Tra
(74) *Attorney, Agent, or Firm*—Steven A. Shaw; W. James Brady; Frederick J. Telecky, Jr.

(57) ABSTRACT

Ensuring sufficient bias current is provided to a portion of a circuit containing low voltage transistors operating with a high supply voltage. Such a sufficient bias current may be ensured by generating a primary bias current from a low supply voltage and a backup bias current from a high supply voltage, and providing the backup bias current as the bias current if the primary bias current is not present. The primary bias current may be provided as the bias current when the low supply voltage is available. Thus, the backup bias current is provided as bias current in case of undesirable supply sequencing.

5 Claims, 2 Drawing Sheets

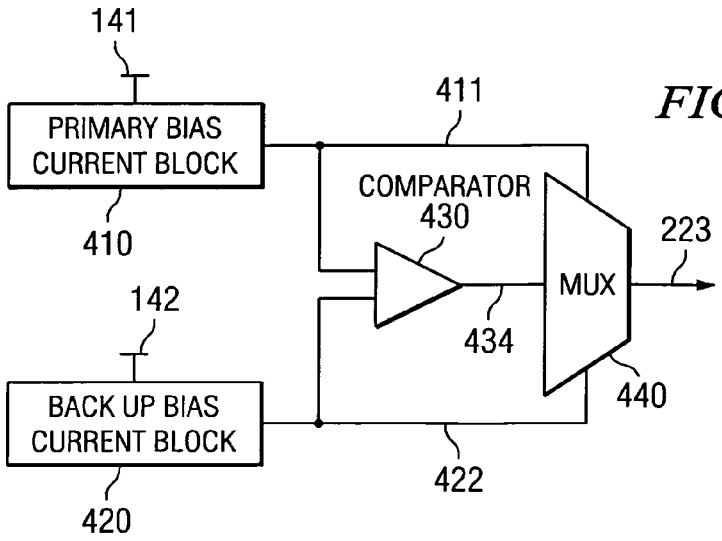
FIG. 4
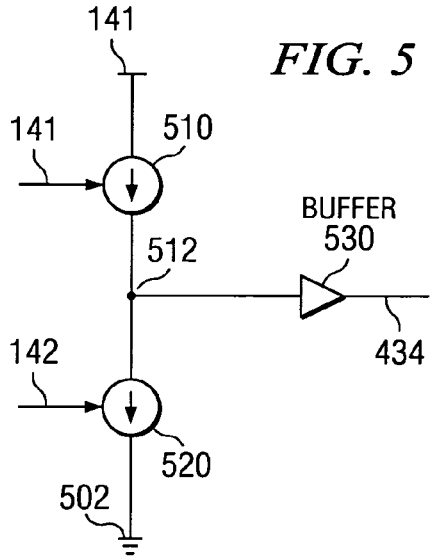
FIG. 5
FIG. 6
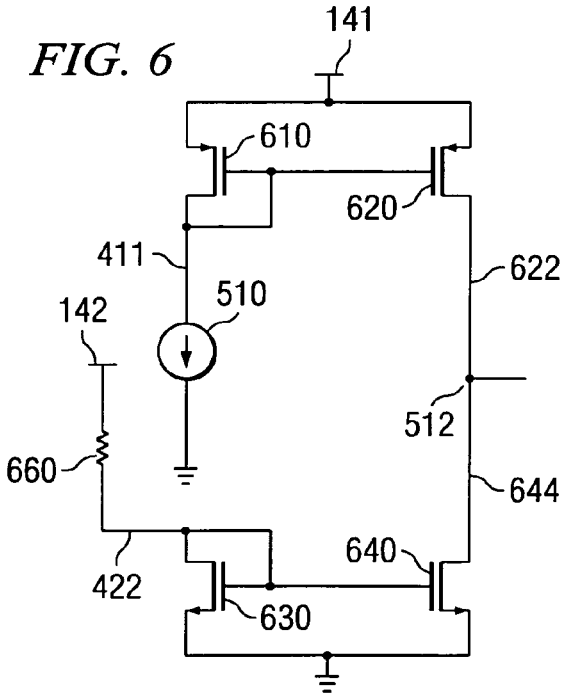
FIG. 7
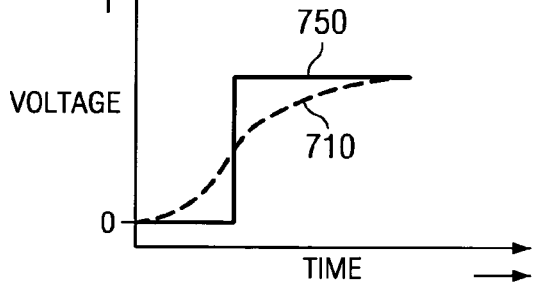

AVOIDING EXCESSIVE CROSS-TERMINAL VOLTAGES OF LOW VOLTAGE TRANSISTORS DUE TO UNDESIRABLE SUPPLY-SEQUENCING IN ENVIRONMENTS WITH HIGHER SUPPLY VOLTAGES

BACKGROUND OF THE INVENTION

1. Field of the Invention

The present invention relates to integrated circuits operating with multiple supply voltages of different magnitudes, and more specifically to a method and apparatus for avoiding excessive cross_terminal voltages of low voltage transistors due to undesirable supply_sequencing in environments with higher supply voltages.

2. Related Art

Integrated circuits are some times implemented with low voltage transistors in high voltage environments. A low voltage transistor is characterized by a correspondingly having a correspondingly low value for the maximum permissible cross terminal voltage. Exposure of the low voltage transistor to higher cross terminal voltage (than permissible cross terminal voltage) may reduce the lifetime of the low voltage transistor, as is well known in the relevant arts.

A high voltage environment is characterized by a high supply voltage (which is used to operate the various low voltage transistors). The word high implies that the supply voltage is more than the maximum permissible cross terminal voltage of the transistors. Using a high supply voltage generally provides a correspondingly high signal to noise ratio (SNR), typically leading to less susceptiblity to noise in processing input signals.

Integrated circuits are often designed to operate with multiple supply voltages, with one or more of them constituting higher supply voltages. Such multiple supply voltages with different magnitudes enable some portion of integrated circuits to operate from one magnitude of supply voltages, and other portions to operate from another magnitude of supply voltages.

Such designs may be chosen, for example, since low voltage transistors operate with higher throughput performance and low power consumption, and higher supply voltage may be used ether to conform with interface specifications of external devices or for higher SNR, as noted above.

One problem with the use multiple supply voltages is that some supply voltages may be operational while others are not (operational), since some of such situations lead to applications of cross terminal voltages exceeding the maximum permissible values (noted above) when low voltage transistors are being operated with high supply voltages. Such excessive cross terminal voltages may be applied, for example, because portions of the integrated circuit which avoid such application, may be non-operational in the corresponding situation(s).

Such situations are of particularly likely to occur during the power-up or power-down of the devices using the integrated circuit since different supply voltages could "come up" (during power-up, or "come down" during power down) at different time instances, albeit within a short duration. The sequence in which the power supplies come up (or come down) is referred to as supply sequencing.

From the above, it may be appreciated that an undesirable supply sequencing may lead to excessive cross terminal voltages being applied across low voltage transistors. What is therefore needed is a method and apparatus to avoid excessive cross_terminal voltages of low voltage transistors due to undesirable supply_sequencing in environments with higher supply voltages.

BRIEF DESCRIPTION OF THE DRAWINGS

The present invention will be described with reference to the following accompanying drawings.

FIG. 4 is a block diagram illustrating the manner in which exposure of low voltage transistors to excessive cross terminal voltages can be avoided according to an aspect of the present invention.

FIG. 5 is a block diagram is a block diagram illustrating the implementation principal of various blocks of FIG. 4 in one embodiment.

FIG. 6 is a circuit diagram illustrating the implementation details of various blocks of FIG. 4 in one embodiment.

FIG. 7 is a timing diagram illustrating the operation of a buffer in one embodiment.

DETAILED DESCRIPTION OF THE PREFERRED EMBODIMENTS

1. Overview

An aspect of the present invention ensures that sufficient bias current is provided to a portion of a circuit ("circuit portion") containing low voltage transistors operating with a high supply voltage (having a magnitude greater than the maximum permissible cross terminal voltage of transistors contained in the circuit portion) irrespective of supply sequencing. Due to such a bias current, exposure of the transistors to excessive cross terminal voltages is avoided.

Such a sufficient bias current may be ensured by generating a primary bias current independent of PVT from a low supply voltage for high reliability, and a backup bias current from a high supply voltage, and providing the backup bias current as the bias current if the primary bias current is not present. The primary bias current may be provided as the bias current when the low supply voltage is available. Thus, the backup bias current is provided as bias current in case of undesirable supply sequencing.

Several aspects of the invention are described below with reference to examples for illustration. It should be understood that numerous specific details, relationships, and methods are set forth to provide a full understanding of the invention. One skilled in the relevant art, however, will readily recognize that the invention can be practiced without one or more of the specific details, or with other methods, etc. In other instances, well_known structures or operations are not shown in detail to avoid obscuring the invention.

2. Example Device

Figure 1:
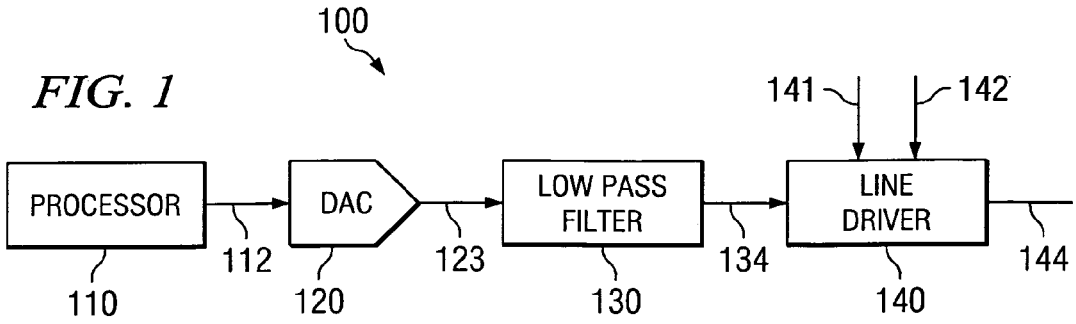
FIG. 1 is a block diagram illustrating the details of an example device in which various aspects of the present invention are implemented.

FIG. 1 is a block diagram of the details of an example device in which various aspects of the present invention can be implemented. Device 100 is shown containing processor 110, digital to analog converter (DAC) 120, low pass filter 130, and line driver 140. Each block is described below in further detail.

Processor 110 generates digital (on path 112), which need to be transmitted to external deices. DAC 120 converts the digital codes (received on path 112) into corresponding analog signals, and provides the analog signals on path 123. Low pass filter 130 performs filtering operation to remove unwanted frequency components from the analog signals generated by DAC 120, and the filtered signal is provided on path 134. Processor 110, DAC 120 and filter 130 may be implemented in a known way.

Line driver 140 reeves the filtered signal on path 134, provides the filtered signal with a desired power/voltage level to drive transmission line 144. Line driver 140 further operates from low voltage supply 141 as well as high voltage supply 142. The high voltage supply has a magnitude greater than a maximum permissible voltage that can be applied across terminals of some transistors contained in line driver 140. Various aspects of the present invention protect such low voltage transistors from exposure against such excessive cross terminal voltages, when low voltage supply 141 is not present. The details of an embodiment of line driver 140 are described in further detail with reference to FIG. 2.

3. Line Driver

Figure 2:
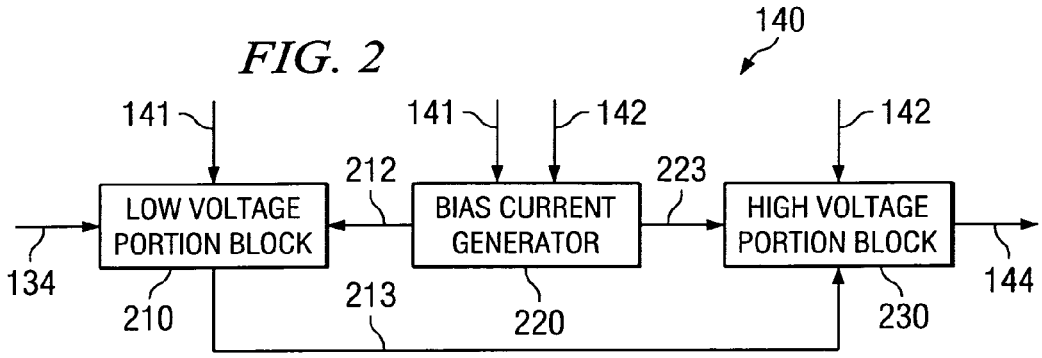
FIG. 2 is a block diagram illustrating the details of a line driver in which various aspects of the present invention can be implemented.

FIG. 2 is a block diagram illustrating the details of line driver 140 in an embodiment of the present invention. Line driver 140 is shown containing low voltage portion block 210, bias current generator 220, and high voltage portion block 230. Each block is described below in further detail.

Low voltage portion block 210 operates from a low voltage supply (e.g., 3 V) received on path 141, and generates an amplified signal on path 213. In addition, abs voltage signal is generated on path 212.

Bias current generator 220 generates a bias current on path 223 using both low voltage 141 and high voltage 142, and provides bias current to both low voltage portion block 210 and high voltage portion block 230. The details of implementation of an example embodiment of bias current generator 220 according to various aspects of the present invention, are described in sections below.

High voltage portion block 230 operates from a high voltage supply (e.g., 12 V) received on path 142, and generates an amplified signal which drives transmission line 144. High voltage portion block 230 is implemented using some low voltage transistors (e.g., transistors designed with 3V specification having a maximum permissible cross terminal voltage of 4V).

The bias current received on path 223 is used to protect low voltage transistors from receiving cross terminal voltages exceeding the maximum permissible voltage levels. The absence of bias current may expose the low voltage transistors to excessive cross terminal voltages, and damage the transistors as described below with reference to FIG. 3.

4. Damage to Transistors in the Absence of Bias Current

Figure 3:
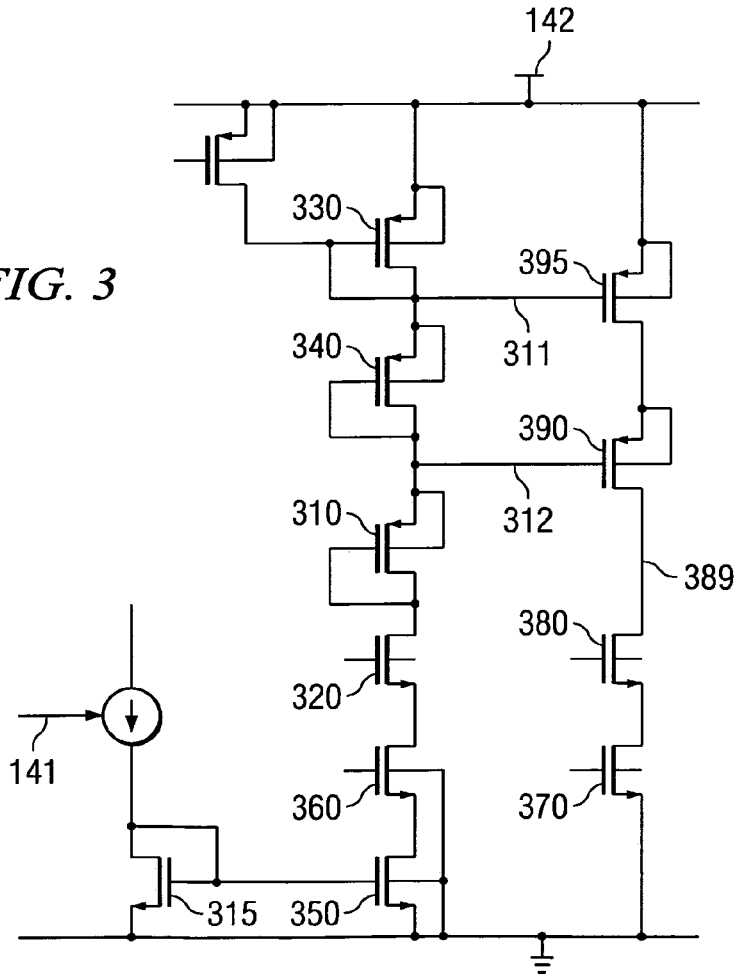
FIG. 3 is a circuit diagram of the details of a portion of the line diver illustrating the manner in which low voltage transistors can be exposed to excessive cross terminal voltages in an example scenario.

FIG. 3 is a circuit diagram of a portion of high voltage portion block 230, illustrating the manner in which low voltage transistors can be damaged in the absence of bias current generated on path 223. The portion is shown containing NMOS transistors 315, 320, 360, 350, 380 and 370, and PMOS transistors 310, 330, 340, 390 and 395. It should be appreciated that the other portions of high voltage portion block 230 are not shown to avoid obscuring various aspects of the present invention.

Transistors 320 and 380, implemented as high voltage transistors, operate to protect transistors 350, 360 and 370 when bias current is present. The combination of transistors 315 and 350 operates as a current mirror. In the absence of low bias voltage 141, transistor 350 turns off, which will pull nodes 311 and 312 to high voltage supply 142. However, depending on the bias at the gate of 370 the potential at path 389 can go to ground which causes excess cross terminal voltage and may damage the transistor 390.

Several other transistors also may be similarly damaged due to similar reasons. Accordingly, it is generally desirable that bias current be always provided when device 100 is operational (or powered on).

One possible reasons for the absence of such bias current on path 223 is that low voltage supply 141 is not present when high voltage supply 142 is present, for example, because of low voltage supply 141 'comes up' after high voltage supply 142 during initialization of device 100. The manner in which the presence of bias current can be ensured according to various aspects of the present invention is described below in further detail.

5. Ensuring the Presence of Bias Current

FIG. 4 is a block diagram illustrating the manner in which presence of bias current can be ensured according to various aspects of the present invention. The block diagram is shown containing primary bias current block 410, backup bias current block 420, comparator 430, and multiplexor 440. Each block is described below in detail.

Primary current block 410 generates primary bias current (on path 411) using low voltage supply 141. In the absence of low voltage supply 141, primary bias current is also absent. As described below in further detail, the primary bias current is provided as bias current 223 in normal operating conditions when low voltage supply 141 is available.

Backup current block 420 generates backup bias current (on path 422) using high voltage supply 142. Backup current block 420 may be designed to provide the sane order of current as primary bias current to avoid damage to the low voltage transistors (e.g., 390).

The implementation of backup current block 420 and primary current block 410 will be apparent to one skilled in the relevant arts by reading the disclosure provided herein. In an embodiment, primary current block 410 is implemented to be independent of variations in PTV (process, temperature and voltage), while backup current block is not designed to meet such a criteria.

Comparator 430 compares the primary bias current (411) with the backup bias current (422) and generates a comparison result on path 434. Thus, the comparison result would equal one logical value when the primary bias current is present, and another value otherwise.

Multiplexor 440 selects one of primary bias current (411) and backup bias current (422) according to the comparison result received on path 434. The selected signal is provided on path 223. Thus, the primary bias current is provided on path 223 in normal operating conditions, and the backup bias current is provided when the primary bias current is absent.

Thus, by ensuring that backup bias current is present at least when the primary bias current is absent, damage to various low voltage transistors (in high voltage portion block 230) may be avoided.

The combination of the components of FIG. 4 can be implemented using various approaches. The principle behind an example approach is described first, followed by corresponding implementation details.

6. Implementation Principle

FIG. 5 is a block diagram illustrating the principle of implementing the combination of primary current block 410, backup current block 420 and comparator 430 of FIG. 4. The block diagram is shown containing current sources 510 and 520, and buffer 530. Each block is described below in further detail.

Buffer 530 operates to provide shaper transitions on path 434 in response to transitions occurring at node 512. Buffer 530 may also isolate from node 512 any components further down on path 434. Buffer 530 many be implemented in a known way (e.g., as two inverters connected in series).

Current sources 510 and 520 respectively represent primary current block 410 and backup current block 420, and are shown driving node 512. The currents from the two current sources drive node 512, but the current with higher magnitude determines the voltage level at node 512.

In one embodiment, current source 510 is designed have a magnitude of 2.5 times that of current source 520, which ensures that node 512 is logic '1 in normal operating conditions. As soon as current source 510 becomes lower than 520, the voltage at node 512 starts going down. Thus, the voltage level (and thus the logic value eventually generated by buffer 530) at node 512 is determined by the strength of current in two current sources.

As noted above, under normal conditions, the magnitude of current source 510 is higher than that of current 520, and hence the voltage level at node 512 represents '1'. As a result, the output of buffer 530 would indicate whether the primary bias current or backup bias current is to be provided as the bias current on path 223. The description is continued with respect to an example implementation using the principle described above.

7. Implementation Detail

FIG. 6 is a circuit diagram illustrating the implementation details of the combination of primary current block 410 and backup current block 420 in one embodiment. The circuit diagram is shown containing PMOS transistors 610 and 620, NMOS transistors 630 and 640, current source 510 and resistor 660. Each component is described below.

Current source 510 provides pri may bias current on path 411. The combination of PMOS transistors 610 and 620 operate as a current mirror circuit, and thus path 622 contains the sane amount of current as on path 411. Current source 520 of FIG. 5 is implemented using NMOS transistors 630 and 640, and resistor 660, as will be apparent from the description below.

Resistor 660 receives high voltage supply 142 and generates backup bias current on path 422. The resistance value of 660 is chosen to generate backup b current of a desired magnitude. The combination of NMOS transistors 630 and 640 operate as a current mirror, due to which path 644 would contain same current as on path 422. Paths 644 and 622 are connected at node 512.

It should be appreciated that the voltage at node 512 changes gradually when the two current sources are operative. However, buffer 530 operates to provide sharp transitions, as described below with reference to FIG. 7.

FIG. 7 is a timing diagram, with line 710 depicting the voltage at node 512 and line 750 depicting the output of buffer 530 on path 434. The peak voltage level of the two signals (710 and 750) equals the low voltage level 141. As can be readily observed, the transitions on line 750 are sharp compared to the gradual change on line 710.

Even though the examples above are described with reference to ensuring the presence of bias current in the absence of low voltage supply, the presence of bias current may be ensured in the absence of high voltage supply as well, as may be desirable in specific situations. Such implementations are covered by various aspects of the present invention.

9. Conclusion

While various embodiments of the present invention have been described above, it should be understood that they have been presented by way of example only, and not limitation. Thus, the breadth and scope of the present invention should not be limited by any of the above described exemplary embodiments, but should be defined only in accordance with the following claims and their equivalents.

What is claimed is:

1. A device comprising:

a processor generating a plurality of digital data elements;

a digital to analog converter (DAC) converting said plurality of digital data elements into an analog signal;

a filter performing a filtering operation on said analog signal to generate a filtered signal; and a line driver driving a transmission line based on said filtered signal, said line driver comprising a circuit portion and a bias generation circuit, said bias generation circuit generating a bias current for said circuit portion, said circuit portion containing a plurality of transistors of a low voltage specification, said circuit portion operating using a first supply voltage, wherein said first supply voltage is greater than said low voltage specification, said bias generation circuit comprising:

a primary current block generating a primary bias current using a second supply voltage, wherein said second supply voltage is less than said first supply voltage;

a backup current block generating a backup bias current using said first supply voltage; and a multiplexor selecting one of said primary bias current and said backup bias current as said bias current.

2. The device of claim 1, wherein said multiplexor selects said backup bias current as said bias current when said second supply voltage is not present.

3. The device of claim 2, wherein said multiplexor performs said selecting according to a select signal connected to a node, wherein said primary current block comprises a first current source and said backup current block comprises a second current source, wherein said first current source and said second current source drive said node.

4. The device of claim 3, wherein said second current source comprises:

a resistor connected between said first supply voltage and a first node;

a first NMOS transistor; and a second NMOS transistor, wherein the drain terminal of said first NMOS transistor is connected to each of said first node and the gate terminal of said first NMOS transistor, the drain terminal of said second NMOS transistor is connected to said node, the gate terminal of said first NMOS transistor is connected to the gate terminal of said second NMOS transistor, and the source terminal of each of said first NMOS transistor and said second NMOS transistor are connected to ground.

5. The device of claim 4, further comprising a current mirror circuit which receives said primary bias current generated by said first current source and provides said primary bias current at said node.

* * * * *